US011554841B1

(12) United States Patent
Berube et al.

(10) Patent No.: US 11,554,841 B1
(45) Date of Patent: Jan. 17, 2023

(54) FLUID MEDIUM VEHICLE

(71) Applicant: The United States of America as represented by the Secretary of the Navy, Newport, RI (US)

(72) Inventors: Richard P Berube, Portsmouth, RI (US); Thomas A Merchant, Westport, MA (US)

(73) Assignee: The United States of America as represented by the Secretary of the Navy

( * ) Notice: Subject to any disclaimer, the term of this patent is extended or adjusted under 35 U.S.C. 154(b) by 143 days.

(21) Appl. No.: 17/148,602

(22) Filed: Jan. 14, 2021

(51) Int. Cl.

| | |
|---|---|
| ***B63G 8/18*** | (2006.01) |
| ***B63G 8/00*** | (2006.01) |
| ***B63G 8/08*** | (2006.01) |
| ***B63G 8/39*** | (2006.01) |
| ***B63G 8/32*** | (2006.01) |

(52) U.S. Cl.
CPC ..... *B63G 8/18* (2013.01); *B63G 8/001* (2013.01); *B63G 8/08* (2013.01); *B63G 8/32* (2013.01); *B63G 8/39* (2013.01); *B63G 2008/005* (2013.01)

(58) Field of Classification Search
CPC . B63G 8/18; B63G 8/001; B63G 8/08; B63G 8/32; B63G 8/39; B63G 2008/005
USPC ..... 114/326, 328, 313, 321
See application file for complete search history.

(56) References Cited

U.S. PATENT DOCUMENTS

| | | | | |
|---|---|---|---|---|
| 3,561,387 A * | 2/1971 | Kumm | B63G 8/001 114/322 |
| 3,752,103 A * | 8/1973 | Middleton | B63G 8/16 114/338 |
| 6,089,178 A * | 7/2000 | Yamamoto | B63G 8/08 114/337 |
| 9,694,874 B1 * | 7/2017 | Stackpole | B63B 22/00 |
| 2018/0001981 A1 * | 1/2018 | Boss | B63G 8/08 |

* cited by examiner

*Primary Examiner* — Anthony D Wiest
(74) *Attorney, Agent, or Firm* — James M. Kasischke; Michael P. Stanley

(57) ABSTRACT

A fluid medium vehicle is provided which has a main body and at least one engine attached to the main body. The engine is configured to provide thrust parallel to a thrust axis passing through the main body. A plurality of foils is moveably attached to and extends outwardly from the main body. The plurality of foils is arranged in pairs. Each pair of foils extends from the main body along opposite ends of one of a plurality of foil axes. Each foil axis is perpendicular to the thrust axis, and each foil is constructed as an independently positionable control surface and as an independently controllable propulsion device.

1 Claim, 2 Drawing Sheets

FLUID MEDIUM VEHICLE

STATEMENT OF GOVERNMENT INTEREST

The invention described herein may be manufactured and used by or for the Government of the United States of America for Governmental purposes without the payment of any royalties thereon or therefor.

CROSS REFERENCE TO OTHER PATENT APPLICATIONS

None.

BACKGROUND OF INVENTION

1) Field of the Invention

The present invention is directed to the propulsion and control of vehicles moving in a fluid medium.

2) Description of Prior Art

There is growing need for the protection and security of ports and harbors. Inspections to find contraband (i.e. explosive devices and drugs) carried by the hulls of surface and underwater vessels is of great concern. One solution involves the use of expensive and time-consuming diving operations to inspect ships. An accepted alternative to manned operation is the use of remotely operated vehicles to monitor remote areas and hazardous environments. Remotely operated vehicles can typically move through a fluid medium with six degrees of maneuverability.

Unmanned underwater vehicles are used to intercept and engage a target in order to provide confirmation of a threat as well as providing information for interdiction. In addition, operations in a forward area require remote capability to acquire data and to deliver necessary payloads. Therefore, the desired remotely operated vehicles traveling in a fluid medium are those that can be readily adapted to suit a variety of mission areas including reconnaissance and as a delivery platform for sensors or other payloads.

Proper monitoring often requires accurate control within a limited space. The size of the vehicle should be small enough to be easily deployed and operated by a minimal number of personnel without the need for specialized handling equipment. A small size also allows the vehicle to penetrate operational areas normally restricted to divers, swimmers and small boats. The vehicle, although relatively small, should be large enough to carry the payloads necessary to perform the tasks required.

SUMMARY OF THE INVENTION

The present invention is directed to increasing the capabilities of a vehicle moving through a fluid medium such as air and water.

In accordance with the present invention, exemplary embodiments combine axial propulsion in support of high speed by cruising with bimodal foils (e.g., airfoils and hydrofoils). The bimodal foils act as both control surfaces and independently vectored propulsion devices in different modes of operation that support remote operated vehicle (ROV) maneuvering.

In one embodiment, the present invention is directed to a fluid medium vehicle (such as an unmanned underwater vehicle) with the vehicle configured to support traditional cruising as well as ROV-like maneuvering. The vehicle achieves this capability through the utilization of one or more engines. The propulsion of the vehicle is provided by either the engines or the foils, or a combination of both depending on the type of maneuvering required.

Each foil is capable of generating independent forces that are combined to enable the fluid medium vehicle to travel freely through three-dimensional space with 6-Degrees Of Freedom (6-DOF). The foils are bi-modal in that the foils can independently oscillate (or flap) to generate propulsion forces or can be used as independent control surfaces when the vehicles cruise more conventionally by using the engines as axial thrusters for propulsion.

The dual functionality of each foil allows for simplified construction of the fluid medium vehicle. While a traditional torpedo-like arrangement requires eight to nine systems with thrusters (four cross tunnel thrusters plus one axial and at least four control surfaces); the fluid medium vehicles in accordance with the present invention utilize as few as five to six devices (four foils and one to two axial thrusters). This arrangement minimizes the design required for propulsion and control. Furthermore, the mounting of the foils on the outboard portion of the main body of the fluid medium vehicle provides for a continuous volume for sensors and payloads that traditional cross tunnel thrusters would obstruct.

The foils support a continuous payload volume and lessen the constraints when the payloads are positioned within the vehicle. In one embodiment, the main body is shaped as a foil which dramatically improves the dynamic maneuvering of the vehicle. However, the shape of the main body can be selected to suit other mission requirements.

In one embodiment, the fluid medium device includes a deployable buoy tethered to the main body. This arrangement facilitates operation at depth while providing real-time remote sensor feedback. The buoy supports a command and control interface as well as providing sensor data communication.

The fluid medium vehicle is capable of cruising and detecting objects of interest using side scan or forward-looking sonar; stopping and hovering at a particular height or depth; orbiting an object to provide a 360 degree inspection; and raising a buoy to provide operators with the imagery and other sensor data products collected. The fluid medium vehicle can then respond based on payloads and sensors; thereby, hastening the process of detection, localization and interdiction.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

Figure 1:
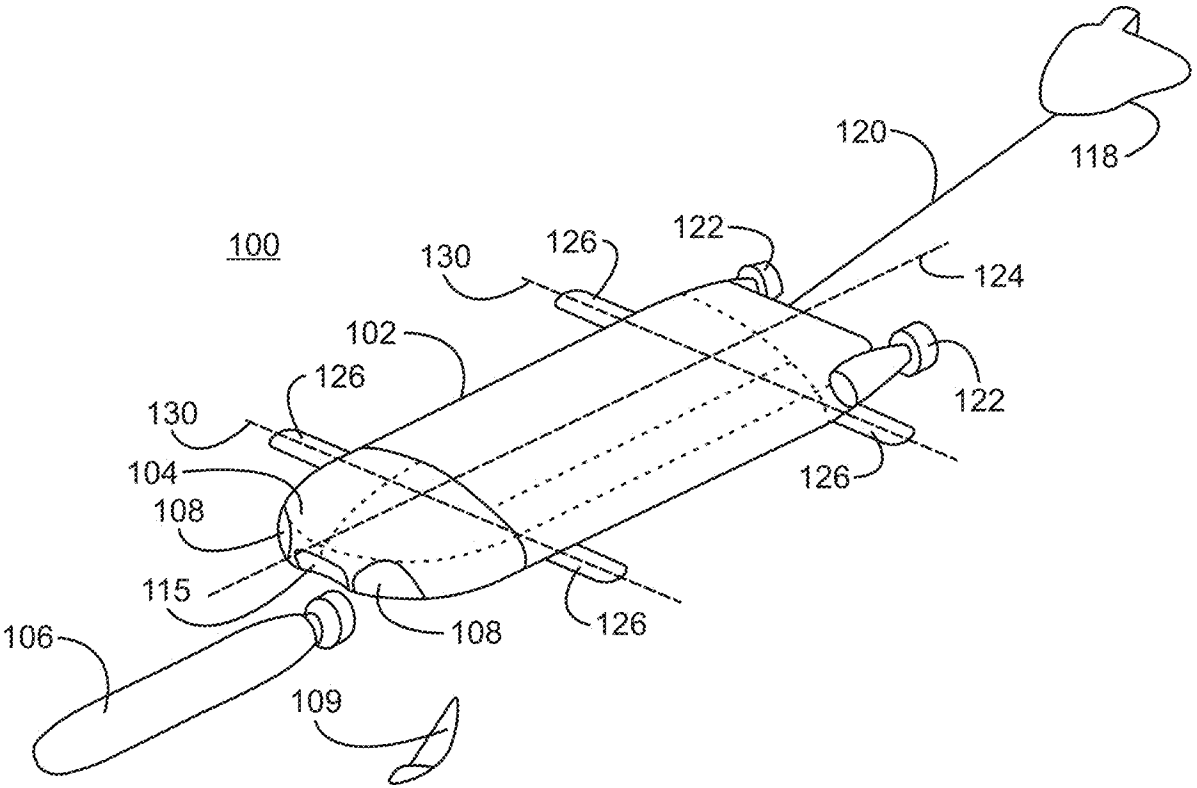
FIG. 1 is a top perspective view of an embodiment of a fluid medium vehicle in accordance with the present invention with a deployed buoy and payload.
Figure 2:
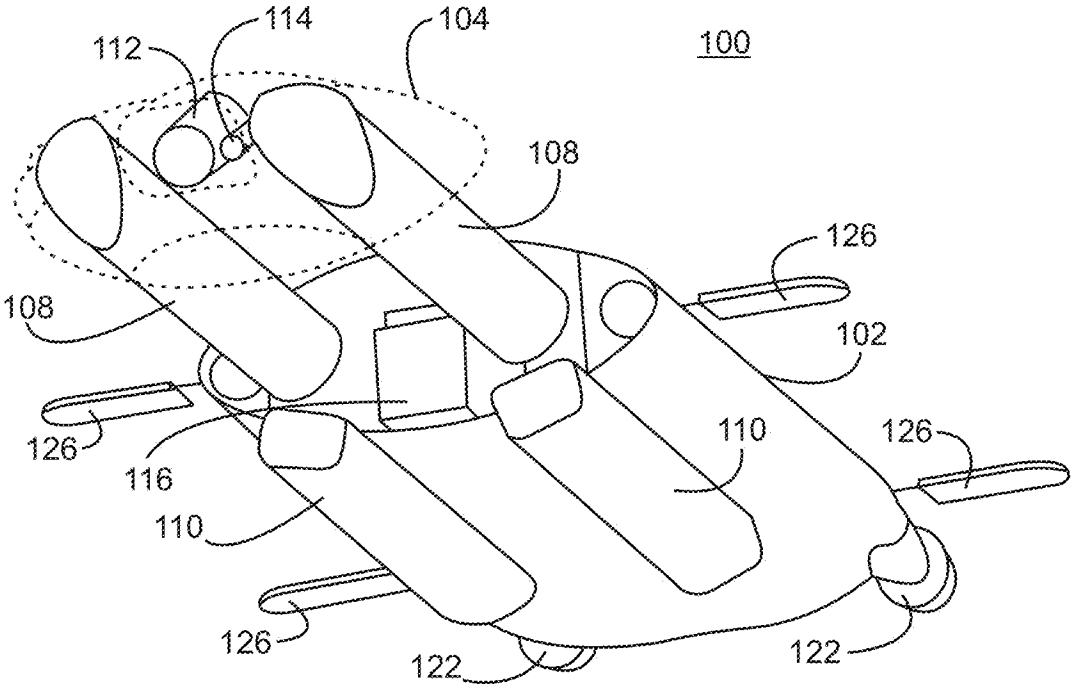
FIG. 2 is a partially-exploded bottom perspective view of the fluid medium vehicle of the present invention.

Referring to FIG. 1 and FIG. 2, an exemplary embodiment of a fluid medium vehicle 100 in accordance with the present invention is illustrated. As illustrated, the fluid medium vehicle 100 is an unmanned undersea vehicle (UUV); however, any type of vehicle configured to move through a fluid medium can be used. Fluid medium vehicles can include aircraft, drones, surface vessels, unmanned surface vessels (USV), spacecraft and manned undersea vehicles.

The fluid medium vehicle 100 includes a main body 102 as a mechanical frame to secure core vehicle components. Suitable materials for the main body 102 include any material that is compatible with the fluid medium in which the vehicle is located. Preferably, the shape of the main body 102 is elongated and has an aerodynamic or hydrodynamic shape. In one embodiment, the main body 102 is shaped as an airfoil or as a hydrofoil to enhance maneuverability.

The main body 102 holds the payloads, power sources and control electronics for operation in the fluid medium. In one embodiment, the main body 102 includes a payload section 104. Preferably, the payload section 104 is capable of being reconfigured in the field.

For field use, a nose section of the body 102 is detachable and would include the payload section 104. Various nose sections can be configured with mission dependant sensors and payloads. An appropriate nose section is attached to support mission requirements. Referring to FIG. 2 and in one embodiment, the payload section 104 is illustrated. The payload section 104 includes an underwater camera 112 and sonar 114 and as well as two deployment tubes 108.

FIG. 1 depicts a payload that could be loaded in the deployment tubes 108 to support mission operations. Other missions are supported by simply changing nose sections in accordance with the mission. The other sections of the fluid medium vehicle 100 remain intact; thereby, maintaining core functions—including navigation, energy, propulsion, and control regardless of the mission packages configured in the nose. This allows the fluid medium vehicle 100 to be configured for a variety of missions or uses while maintaining core vehicle functions including navigation, energy, propulsion and control.

The main body 102 can also include interdiction devices or deployable payloads 106 (which in FIG. 1, is illustrated as a torpedo). The interdiction devices or deployable payloads are housed within and launched from the deployment tubes 108 in the main body 102. These tubes 108 can house or deploy other types of payloads including, but not limited to, side scan sonar electronics, chemical sensors and conductivity, temperature and depth (CTD) sensors. The forward end of the tube 108 is open and is covered by a releasable cap 109. The releasable cap 109 is ejected upon deployment of the payload 106.

In one embodiment, the main body 102 includes a pair of side scan sonar arrays 110 running along the length of the main body—shown on the underside of the main body. The side scan sonar arrays 110 can be attached to the main body 102 by using quick release mechanisms.

The camera 112 and the imaging sonar 114 are preferably located within a port 115 on the forward portion of the main body 102. Also included within the main body 102 are control electronics, power sources and communication electronics 116. Suitable power sources include, but are not limited to, batteries, fuel cells, photovoltaic cells and combinations thereof. The devices and sensors of the fluid medium vehicle 100 are in communication with the electronics and powers sources as required. The main body 102 can be configured to have any combination of these components.

In one embodiment, the fluid medium vehicle 100 includes a deployable and retractable buoy 118 tethered to the main body 102 by a cable 120 that provides attachment and communication to the electronics and power supply of the main body.

In this embodiment, the main body 102 can include a winch (not shown) for deploying and retracting the buoy 118. The buoy 118 provides command and control communications between the vehicle 100 and the remote operators of the vehicle; image data collection remote from the vehicle; and sensor data remote from the vehicle as well as communication of the image and sensor data to the remote operators.

The fluid medium vehicle 100 includes at least one engine 122 attached to the main body 102 and configured to provide thrust along a thrust axis 124. In general, the engines 122 are configured as independent thrusters to support the cruising capabilities of the vehicle 100. In addition, the engines 122 acting as axial thrusters support steering of the fluid medium vehicle 100 through throttling of the axial thrusters.

By independently controlling the revolutions per minute (RPM) of the port and starboard thrusters; the fluid medium vehicle 100 can be steered to a course as well as controlling the rate of turns. Suitable engines include, but are not limited to, propellers including screw propellers, impellers, turboprop engines, jet engines and jet propulsion engines, as well as bio-robotic oscillating foils designed to replicate tails.

In one embodiment, the fluid medium vehicle 100 includes two engines 122 attached to the main body 102. Both of the engines 122 provide thrust along a thrust axis. Also, the engines 122 are spaced from each other at a sufficient distance to facilitate steering of the main body 102 by throttling the engines.

The fluid medium vehicle 100 includes a plurality of foils 126 moveably attached to and extending outwardly from the main body 102. Preferably, the vehicle 100 includes four foils 126. The foils 126 are arranged or grouped in pairs. Each pair of foils 126 extends from opposite sides of the main body 102 along opposite ends of one of a plurality of foil axes 130. Each foil axis 130 is perpendicular to a thrust axis 124. In one embodiment, the foil axes 130 are coplanar; therefore, the foils extend from the main body on the same plane.

In one embodiment, when the fluid medium vehicle 100 includes two engines 122; the engines are spaced from each other in the same plane containing the foil axes 130.

In another embodiment, the plurality of foils 126 are hydrofoils or airfoils. Each foil 126 is independent of the other foils such that the foil can be controlled and positioned independent of the control and positioning of the other foils. The shape, location and independence of the foils 126 facilitate use as either a control surface when the fluid medium vehicle 100 is being propelled using the engines 122 through the movement or as flapping of the foils in order to generate forces. These forces are coordinated and vectored to provide the desired three-dimensional movement of the fluid medium vehicle 100 in accordance with the necessary magnitude and direction to accomplish the desired maneuver. Simultaneous movement in all six degrees of freedom can be accomplished.

The use of the foils 126 for vectored propulsion facilitates the use of the fluid medium vehicle 100 as a remotely operated vehicle. Therefore, each foil 126 functions as an independently positionable control surface, an independently controllable propulsion device or as both a control surface and propulsion device. The use of the engines 122 and engine throttling in combination with both the control surface and propulsion functionality of the foils 126 provides the desired functionality and maneuverability.

The flapping foil propulsion provided by the foils 126 is more efficient than thruster technology especially in moving water found in an ocean, estuary or river environment. In moving water, the foil technology can be 30-50% more efficient over a thruster alternative. When no flow is present, a flapping foil solution is no less effective when compared to traditional tunnel thruster designs. For UUV type vehicles, additional savings is realized in terms of a simplified system design especially when considering the dual nature of the foils 126.

Separate systems are not required for cruising as well as for ROV-like maneuvering. The need for fewer systems results in weight and energy savings and provides optimized payload volume. Also, the foils 126 of the present invention are significantly quieter and less intrusive in an operating environment.

For example: the oscillations of the foils 126 generate wider band noise vice the tonals of the thrusters. Furthermore, the vortices that shed off the tips of foils 126 dissipate quickly. Given the separation between the foils 126 in the vehicle layout; the impact to the surrounding environment is lessened. This is an advantage when considering areas where an environmental impact is critical (coral and other sea life) or where a lessened magnetic signature of the foils 126 compared to traditional thruster based designs is desirable.

Operationally, the use of foils 126 allows for efficient maneuvering of the vehicle 100 at and near the surface. A plume of water (when the thrusters are used to descend an undersea vehicle) is mitigated as are the violent vortices and the associated churning of matter in the water plume.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. A vehicle for use in a fluid medium, said vehicle comprising:

an elongated main body with a detachable nose section capable of being configured with sensors, said nose section in alignment with a longitudinal axis of said elongated main body;

a payload section encompassed by said elongated main body, said payload section capable of housing at least one deployable payload with said payload section having an underwater camera and sonar at a port on a first end of said payload section as well as at least two adjacent deployment tubes, each of said deployment tubes having an open end covered by a releasable cap wherein said releasable cap can eject upon deployment of the deployable payload;

two spaced apart engines affixed to a rear portion of said main body opposite said nose section with each said engine including a thruster configured to provide thrust parallel to the longitudinal axis of said main body as well as being capable of steering a direction of said main body at alternative angles relative to a longitudinal axis of said main body;

at least four coplanar and bi-modal flapping foil propulsors moveably attached to and extending outwardly from said main body, said at least four coplanar flapping foil propulsors arranged in pairs, each pair extending from said main body along opposite ends of one of a plurality of foil axes with each foil axis perpendicular to the longitudinal axis of said main body wherein each of said bi-modal flapping foil propulsors can independently oscillate in a flapping motion to generate propulsion forces and as independent control surfaces;

a pair of side scan sonars longitudinally and releasably affixed to a longitudinal exterior of said main body; and a retractable buoy tethered to said main body and configured to provide at least one of command and control communications between said vehicle and remote operators of said vehicle, image data collection remote from said vehicle and sensor data remote from said vehicle.

* * * * *